US006585366B2

(12) United States Patent
Nagata et al.

(10) Patent No.: US 6,585,366 B2
(45) **Date of Patent: *Jul. 1, 2003**

(54) IMAGE FORMING METHOD

(75) Inventors: Toru Nagata, Tokyo (JP); Kenji Suzuki, Kawasaki (JP); Hiroshi Ochiai, Samukawa-machi (JP); Hiroshi Miyamura, Machida (JP); Yoshinari Yasui, Chigasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,867

(22) Filed: Aug. 3, 1999

(65) Prior Publication Data

US 2002/0186292 A1 Dec. 12, 2002

(30) Foreign Application Priority Data

Aug. 5, 1998 (JP) ..... 10-221710

(51) Int. Cl.[7] ..... B41J 2/01

(52) U.S. Cl. ..... 347/101; 101/483; 156/238; 347/105; 347/106

(58) Field of Search ..... 347/101, 105, 347/106, 213, 221; 101/483; 356/600; 428/327, 195, 207, 211, 329, 331, 341, 342, 200, 315.1; 430/271.1; 156/231, 232, 238, 241

(56) References Cited

U.S. PATENT DOCUMENTS

| | | | | | |
|---|---|---|---|---|---|
| 5,268,348 | A | * | 12/1993 | Egashira et al. | 428/195 |
| 5,573,865 | A | * | 11/1996 | Steelman et al. | 428/200 |
| 5,576,088 | A | * | 11/1996 | Ogawa et al. | 347/105 |
| 5,582,669 | A | * | 12/1996 | Gove et al. | 156/239 |
| 5,647,935 | A | * | 7/1997 | Hoshino et al. | 156/231 |
| 5,654,799 | A | * | 8/1997 | Chase et al. | 356/571 |
| 5,714,305 | A | * | 2/1998 | Teng et al. | 430/271.1 |
| 5,810,974 | A | * | 9/1998 | Laapotti | 162/358.5 |
| 5,913,587 | A | * | 6/1999 | Kuhasalo et al. | 34/117 |
| 6,025,068 | A | * | 2/2000 | Pekala | 428/315.1 |
| 6,114,022 | A | * | 9/2000 | Warner et al. | 347/106 |
| 6,143,419 | A | * | 11/2000 | Hanada et al. | 428/195 |
| 6,187,430 | B1 | * | 2/2001 | Mukoyoshi et al. | 347/105 |
| 6,335,102 | B1 | * | 1/2002 | Tsubaki et al. | 428/313 |

* cited by examiner

*Primary Examiner*—Eugene H. Eickholt
(74) *Attorney, Agent, or Firm*—Fitzpatrick, Cella, Harper & Scinto

(57) ABSTRACT

Provide is a process for forming images comprising the steps of forming images on a recording medium provided with an ink-receiving layer containing inorganic particles using an ink-jet recording method, and laminating a coat layer onto said ink-receiving layer with images formed thereon, wherein said ink-receiving layer is calendered either before forming images on said ink-receiving layer or before laminating said coat layer after forming images on said ink-receiving layer.

6 Claims, 1 Drawing Sheet

IMAGE FORMING METHOD

BACKGROUND OF THE INVENTION

1. Field of the Invention

The present invention relates to a process for forming images using an ink-jet recording method, in particular a process for forming images comprising laminating a transparent film having a surface on which an image is formed according to the ink-jet recording method.

2. Related Background Art

The ink-jet method, a method capable of depositing a recording liquid such as ink on a recording medium such as paper to record images, characters, various patterns and the like, is easily applicable to a multi-color print also and its application to a higher recording technique has been attempted as technology progresses. Above all, to output image information items electronically incorporated or accumulated in a computer or a network or to output those incorporated by a digital camera, a digital video recorder, an image scanner and the like, for example, application of the ink-jet recording method is demanded. If application of the ink-jet recording method permits images equal to the image quality of a color photograph using a silver halide or a multi-color press print in various printing methods to be formed in the fields mentioned above, there is a possibility of greatly reducing the unit price of image forming and the demand for such a technique is increasing.

As a technique to form a multi-color image equal to that of a silver-halide photograph or multi-color press print according to the ink-jet recording method, there is known a method of using a recording sheet provided with an ink-receiving layer containing a white pigment such as silica or alumina then forming a transparent coat layer on the surface of an ink-receiving layer after forming an image according to the ink-jet recording method, thus promoting the grade of the image by raising the glossiness or smoothness of the image surface. To form a transparent coat layer in this case there is used a method of forming a layer containing resin particles and having ink permeability on an ink-receiving layer, for example, by using a latex or the like and thermally melting these resin particles to make a coat after image forming or a method of laminating a transparent film onto an ink-receiving layer after image forming.

As laminate members used for laminating a transparent film onto an ink-receiving layer of an ink-jet recording sheet to form a transparent coat layer there are known those with a latex layer formed on a heat-resistant substrate. This latex layer is formed of an aggregate of thermoplastic resin particles, to form a layer on the heat-resistant substrate.

Since a process for forming images according to the ink-jet recording method, using a recording sheet with a silica-containing ink-receiving layer provided on a substrate and a laminate member having a latex layer on a substrate in combination, is a technique low in the manufacturing cost of a recording sheet and promising economically, a technique is in demand which enables images equal in quality to a silver halide photograph or a color press printed matter in various printing techniques to be formed by using a combination of these. To improve the contrast, grade or hue of an image, for example, a required optical density of image at a position in request of a high optical density of image must be fully reproduced. When conventionally constructed ones are employed for the recording sheet and laminating member mentioned above, there is a limit for raising the optical density of the image further.

SUMMARY OF THE INVENTION

It is one object of the present invention to provide a technique capable of attaining a high quality image by using the ink-jet recording method and in particular a image forming method capable of effectively attaining a high optical density of image required and forming an image at low cost.

The above object can be achieved by the present invention described below.

According to the present invention, there is provided a process for forming images comprising the steps of forming images on a recording medium provided with an ink-receiving layer containing inorganic particles using an ink-jet recording method; and laminating a coat layer onto said ink-receiving layer with images formed thereon, wherein said ink-receiving layer is calendered either before forming images on said ink-receiving layer or before laminating said coat layer after forming images on said ink-receiving layer.

DESCRIPTION OF THE PREFERRED EMBODIMENTS

Figure 1:
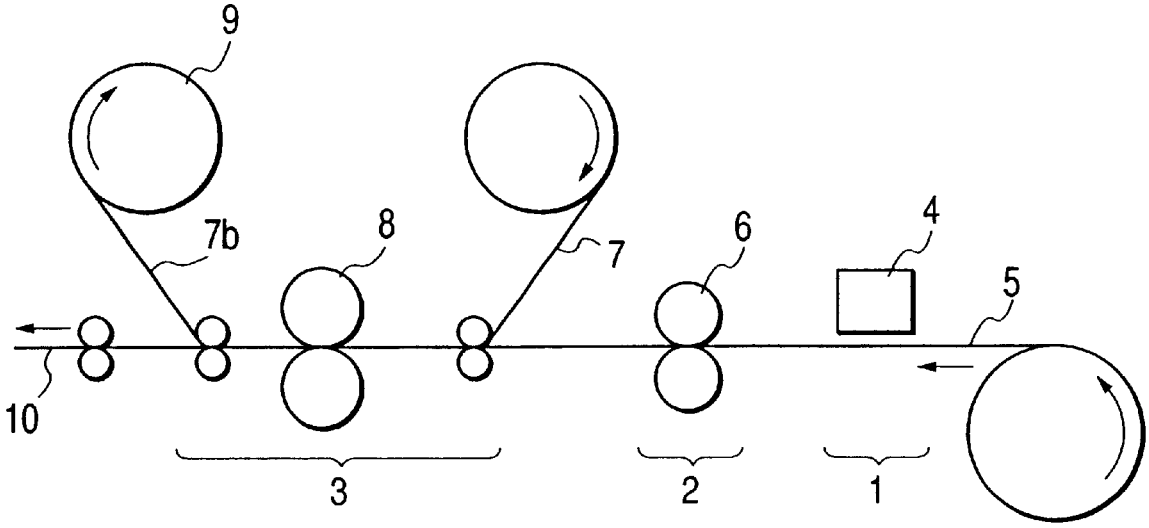
FIG. 1 is a schematic drawing of one example of an image forming apparatus to which the present invention is applicable.

With the present invention, a sufficiently high optical density of image can be obtained by calendering an ink-receiving layer before or after the formation of images according to the ink-jet recording method, for example, at a position where a high optical density of image is requested or is preferable in a printed matter with a transparent film finally laminated on the ink-receiving layer after the image is received, so that a high quality image with respect to contrast, grade, hue or the like can be obtained.

Incidentally, when an inorganic filler having a relatively large particle size, such as silica, is used to form an ink-receiving layer, an unevenness is formed on the surface of the ink-receiving layer and may damage the shape of ink dots, for which damage calendering to the ink-receiving layer is effective. However, such calendering is done for improving the shape of ink dots or the like, in which there is no idea of laminating a coat layer of a transparent film onto the ink-receiving layer for receiving an image in combination with a laminate member using a latex layer.

The reason why calendering is effective for the present invention is considered to be as follows.

When the thickness of a latex layer in a laminate member is set to a small value, thermoplastic resin particles forming the latex layer may be unable to fully penetrate an unevenness on the surface of an ink-receiving layer in the ink-jet recording sheet even if heated till they obtain fluidity. And, if an ink-receiving layer is chiefly formed of silica, this tendency becomes marked. As a result, a transparent film laminated on a concave part does not effectively penetrate through and closely stick to the surface of a silica-containing ink-receiving layer of the printed matter obtained through processing by heating and pressurizing and by peeling off a substrate, so that fine air bubbles are present there. And, the presence of such air bubbles causes a random scattering of light, thereby lowering the optical density of the image observed through the transparent film.

Thus, as seen in the present invention, since laminating a transparent film onto an ink-receiving layer subjected to calendering smooths the convex part of the surface of the ink-receiving layer, a resin constituting a transparent layer becomes likely to effectively penetrate into the concave part, so that the generation of such air bubbles as mentioned above can be avoided. As a result, it is enabled to remove the restriction due to the generation of air bubbles on the optical density of the image observed through the transparent film while retaining the effect of promoting the image grade based on the smoothness, glossiness or the like obtained by laminating the transparent film.

Recording media used in the present invention are so arranged as to have an ink-receiving layer containing porous inorganic particles provided on a substrate. As substrates for recording media, plastic films made of polyethylene, polypropylene, polyethylene terephthalate (PET) or the like and sheets made of paper materials such as woodfree paper, coated paper and laminated paper can be used, among all of which PET and woodfree paper are preferable.

An ink-receiving layer provided on the substrate is formed using porous inorganic particles and can be obtained, for example, by applying and drying a coating liquid containing porous inorganic particles and a binder, if necessary, on the surface of the substrate.

As porous inorganic particles, silica, alumina, magnesium carbonate, silica alumina mixed crystals, silica magnesium mixed crystals or the like can be used. The average particle diameter of inorganic particles is preferably on the order of 0.1 to 10 $\mu$m.

As a binder, a water-soluble polymer made of polyvinyl alcohol, vinyl acetate, acrylic or the like or an emulsion can be used and a combination of two or more of them can be used without impairing the effect of the present invention.

The mixing ratio of a binder to porous inorganic particles can be set to 30 to 1,000 parts by weight and preferably 50 to 500 parts by weight.

Furthermore, to the ink-receiving layer, various additives such as dispersant, fluorescent dye, pH controlling agent, lubricant and surfactant can be added as needed without impairing the effect of the present invention.

In forming an ink-receiving layer, a water-soluble coating liquid, for example, containing inorganic particles such as silica and a binder can be applied on a substrate by using various methods such as roll-coating, rod-bar coating, spray coating and air-knife coating. The coated amount at this time can be set to an amount for providing the layer thickness (e.g., 30 to 60 $\mu$m) of a desired ink-receiving layer, for example, on the order of 30 g/m$^2$ to 60 g/cm$^2$.

Applicable to a laminate member used in the present invention, is an arrangement with a latex layer provided on a heat-resistant substrate and there is no special restriction on the arrangement only if a film can be laminated on the ink-receiving layer for receiving an image according to ink-jet recording. For example, those of a monolayered latex layer provided on the substrate or those of a multi-layered latex layer provided on the substrate can be employed.

A transparent film not made of a latex layer laminated on the ink-receiving layer can be used to make a coat layer, but since use of an arrangement with the heat-resistant substrate peeled off after sticking a latex layer at least onto an image-formed surface of the ink-receiving layer of a recording sheet by heating and under pressure enables the thickness of the surface layer to be made thinner, wrinkling of a coat layer in the transparent film or curling of a finished printed matter can be prevented and the formation of a transparent coat layer on the surface of the ink-receiving layer reduces the diffuse component of light on the surface, thus enabling the optical density of the image to be improved.

As a heat-resistant substrate, any will do only if capable of stably maintaining the shape under heating and pressurizing conditions during the laminating and easily peeling off at the formed stage of a transparent film on the ink-receiving layer. For example, a sheet made of a material such as polyethylene terephthalate (PET), polyethylene naphthalate (PEN), polyphenylene sulfide (PPS) or polyether sulfone (PES) can be used. The thickness of a heat-resistant substrate has only to be set to a thickness suitable for the lamination and can be selected, for example, from a range of from 25 to 50 $\mu$m.

A latex layer in the present invention forms a layer in which particles of a thermoplastic resin are secured so as not to easily fall off from the substrate and can be made into a film by heating. As latex usable for the formation of this latex layer, latex of vinyl chloride, vinyl acetate, styrene, acrylic or the like can be referred to.

The formation of a latex layer is also performed by applying and drying a coating liquid containing a latex on a substrate according to various methods such as roll coating, rod-bar coating, spray coating and air-knife coating. The thickness of an obtained latex layer has only to be set so that the thickness of a transparent film finally laminated on the ink-receiving layer of a recording medium satisfies a desired image quality and can be set, e.g. to the order of 2 to 30 $\mu$m. Besides, in the case of making a latex layer into a multi-layered structure comprising two layers or more, the thickness of their resistive layers has only to be set so that the thickness of a transparent film finally laminated on the ink-receiving layer of a recording medium satisfies a desired image quality and the thickness of the whole latex layer can be set as with that of the monolayered latex layer mentioned above.

Incidentally, to make an image quality better, the thickness of a transparent coat layer finally formed on the ink-receiving layer is advisably set so as to be within a range of from 2 to 30 $\mu$m and preferably from 5 to 10 $\mu$m.

Using the recording medium composed as described above and a laminating member, image forming according to ink-jet recording method can be executed. For ink-jet recording, various methods such as electrostatic suction method, method using a piezoelectric element and method using a heating element can be utilized and are not limited especially.

As ink used for ink-jet recording, any of those containing a colorant such as dye or pigment in an aqueous medium will do only if applicable to the ink-jet recording method. Also in the case of making a color record, a full-color image can be printed by the subtraction color mixture using cyan, magenta and yellow, and further black, if necessary, according to an ordinary method.

When an image is formed by shooting an ink to the ink-receiving layer of a recording medium in response to an image information item, a latex layer is bonded to the ink-receiving layer under pressure to make a transparent film by overlapping a laminating member on the surface of the recording medium on the side of the ink-receiving layer from the side of the latex layer and passing it between a pair of opposed rollers under heating and pressurizing situations. By peeling off the substrate of the laminating member from the transparent film on the ink-receiving layer, the lamination is completed. The heating and pressurizing conditions in the lamination have only to be chosen so as to be satisfactory for obtaining a transparent film having a desired thickness and desired characteristics from the laminate layer. Those comprising a surface temperature of 150° C. and a linear load of 7 N/cm, for example, can be preferably used.

In the present invention, calendering is applied to the surface of the ink-receiving layer either before the ink-deposit or before the forming of a coat layer after the ink-deposit. By smoothing the unevenness of the ink-receiving layer, in particular the head of convex portions, this calendering chiefly aims not only at surely increasing the contact area of the ink-receiving layer surface with the latex layer at the time of pressurized sticking but also at preventing a reduction in the optical density of an image due to the remaining air bubbles in concave portions as a result of effective intrusion of a melt resin supplied from the latex layer into the concave portions and is executed under conditions capable of attaining such an object. For calendering, for example, a method of passing a recording medium between a pair of opposed rollers capable of applying a predetermined pressure to the surface of an ink-receiving layer can be adopted, if necessary, under heating situations and the conditions for calendering of a heating temperature within a range of from 20 to 100° C. and a linear load within a range of from 50 to 1,200 N/cm, for example, are preferable. Besides, the diameter of a pressurizing roller is preferably set to a range of from 40 to 400 mm.

By subjecting an ink-receiving layer to calendering according to the present invention, the quality of an image can be made much higher than the image quality for an ink-receiving layer not subjected to calendering in forming a transparent film on the ink-receiving layer. Especially, without the optical density inherent in the high optical density part of an image being injured by laminating a transparent film, the maximum optical density of an image, for example, can be effectively increased by this lamination, thereby enabling a better contrast to be expressed in an image.

Calendering can be made either before or after the ink-deposit, but its execution after the ink-deposit is preferable. This is because the surface state often changes before and after the ink-deposit on account of a partially different deposited ink quantity depending on the image information item. In consequence, the effect of improvement in the optical density of an image in the case of calendering after the ink-deposit is obtained by the degree corresponding to the absence of effect exerted on the ink-receiving layer by the ink-deposit as compared with the case of calendering before the ink-deposit. Besides, in the case of calendering before the ink-deposit, careful consideration must be given to setting the calendering conditions because characteristics such as ink absorption based on the porous structure of the ink-receiving layer surface are affected by calendering. In contrast, calendering after the ink-deposit eliminates the need for such careful consideration.

Figure 2A:
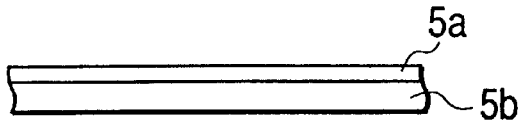
FIGS. 2A, 2B and 2C are schematic sectional views showing one example of steps of laminating a coat layer on a recording layer.
Figure 2B:
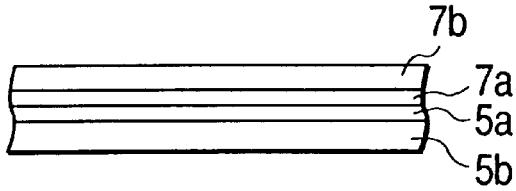
Figure 2C:
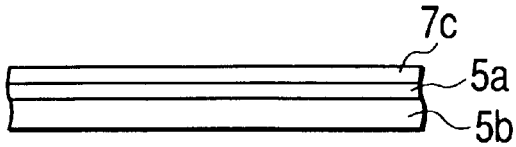

The principal part of one example of image forming to which the present invention is applicable is schematically shown in FIG. 1. The apparatus of FIG. 1 comprises an ink-jet recording section 1 for making an ink-jet record on the surface of a recording medium wound in a roll on the side of an ink-receiving layer, a calendering section 2 for calendering and a laminating section 3 for lamination. The ink jet recording section 1 has the recording head 4, and gives ink to the ink-receiving layer 5*a* on the substrate 5*b* of the recording medium 5 shown in FIG. 2A in response to an image information item to form an image. After ink-deposit, the recording medium passes between a pair of rollers 6 and is calendered by heating and under pressure. Next, to the ink-receiving layer 5*a* of the recording medium 5 after the calendering, a laminating member 7 is laminated from the side of a latex layer 7*a* shown in FIG. 2B, passed between a pair of rollers 8 with the lamination condition retained, then heated and pressurized. By this treatment, resin particles in the latex layer 7*a* are melted and stuck to the ink-receiving layer under pressure to make a film. Since the temperature lowers after the pass between a pair of rollers 8, the film is fixed on the ink-receiving layer 5*a* as a transparent film 7*c* shown in FIG. 2C. Furthermore, by pulling the substrate 7*b* of the laminating member 7 in the winding device 9, the substrate 7*b* can be peeled off from the ink-receiving layer 5*a*. The printed matter 10 obtained thus, having the constitution shown in FIG. 2C, is cut into a required length by using a cutter (not shown) or the like and a sheet of printed matter can be obtained. In a case where calendering is executed before the ink-deposit, the calendering section 2 is placed in the front of the ink-jet recording section 1.

Incidentally, the example of FIG. 1 relates to the case of utilizing a recording medium wound in a roll, but the configuration of individual sections may be appropriately modified so that the obtained printed matter can be treated as a sheet having a predetermined length.

The same Reference numerals have the same meaning throughout FIGS. 1, 2A, 2B and 2C.

Hereinafter, referring to examples or the like, the present invention will be described in further detail.

EXAMPLE 1

Two (2) parts by weight of binder resin emulsion (NS 120-XK, trade name, product of Takamatsu Yushi KK) was added to one (1) part by weight of silica (Mizukasil P-50, trade name, product of Mizusawa Chemical Industries), so as to have a solids content of 20% by weight, and the mixture was dispersed to prepare a coating liquid. This coating liquid was applied onto woodfree paper having a basis weight of 186 g/m$^2$ by means of a slot die coater so as to become a film having a dry thickness of 30 $\mu$m and dried to obtain a recording medium.

On the other hand, a latex solution (Vinyburan 602 stock solution, trade name, product of Nisshin Chemical Industries Co., Minimum Film-making Temperature (MFT): 130° C.) was applied by means of a gravure coater onto a 38 $\mu$m thick PET sheet as a heat resistant substrate, so as to have a dry film thickness of 2 $\mu$m, and was dried at 130° C. to obtain a latex layer making the surface layer of a transparent film. Furthermore, onto this layer, a latex solution (Vinyburan 240 stock solution, trade name, product of Nisshin Chemical Industries Co., MFT: 10° C.) was applied by means of a gravure coater so as to have a dry film thickness of 6 $\mu$m and was dried at 100° C. to form a latex layer making an adhesive layer and obtain a laminating member.

Next, onto the ink-receiving layer of a recording medium, 100% of a black ink and 50% of cyan, magenta and yellow inks, respectively, considering an amount of ink corresponding to 720,000 ink drops of 8.5 pl in volume shot in 1 inch square as 100%, were shot using a Hyperphoto Printer H-100 (product of Canon Inc.) to form a black area. The optical density of image of this portion was measured using a densitometer TR 924 (product of Macbeth Co.). The results are shown in Table 1.

After the ink-deposit, calendering (roll diameter: 63 mm; linear load: 1,200 N/cm; temperature: 50° C.) was executed, then a laminating member and a recording medium after the recording were joined on each other so that the latex layer side of the former came into contact with the ink-receiving layer side of the latter, passed between a pair of rotating rollers (roll diameter: 63 mm; linear load: 7 N/cm; temperature: 150° C.) and subjected to heating and pressurizing treatment, while a transparent film obtained from the latex layer was laminated onto the ink-receiving layer and a PET substrate was peeled off to obtain a printed matter with the laminate of the transparent film provided on the image-received ink-receiving layer. The optical density of image of the obtained printed matter was measured by the method mentioned above. The results are shown in Table 1.

EXAMPLE 2

Except that calendering was executed before the ink-deposit, a printed matter was prepared as in Example 1. Besides, the optical density of image after the ink-deposit and after the calendering was measured as in Example 1. The results are shown in Table 1.

Comparative Example 1

Except that calendering was not executed, a printed matter was prepared as in Example 1. Besides, the optical density of image after the ink-deposit and after the calendering was measured as in Example 1. The results are shown in Table 1.

TABLE 1

| | Optical Density | |
|---|---|---|
| | After ink-deposit | After laminating |
| Example 1 | 1.5 | 2.5 |
| Example 2 | 1.7 | 2.3 |
| Comparative Example 1 | 1.5 | 2.0 |

According to the present invention, in preparing a printed matter with a transparent film laminated on the ink-receiving layer on which images are formed according to the ink-jet recording method that is formed by a combination of a recording medium with an ink-receiving layer containing porous inorganic particles provided on a substrate and a laminating member for laminating a coat layer to the ink-receiving layer, the optical density of image of an image portion in need of producing a high optical density of image can be increased by subjecting the surface of an ink-receiving layer to calendering, thus improving the image quality, so that images equal in quality to those of a color record in a silver halide photograph or various press prints can be obtained.

What is claimed is:

1. A process for forming images comprising the steps of:

forming images on a recording medium having an ink-receiving layer comprising inorganic particles using an ink-jet recording method;

calendering said ink-receiving layer with images formed thereon; and laminating a coat layer onto said ink-receiving layer with images formed thereon after the calendering;

wherein said calendering step reduces unevenness at the surface of the ink-receiving layer.

2. The process for forming images according to claim 1, wherein said coat layer is formed by heating and pressurizing a latex layer for adhesion.

3. The process for forming images according to claim 2, wherein said latex layer, provided on a substrate, is laminated onto said ink-receiving layer and heated and pressurized for adhesion, then said substrate is separated from said ink-receiving layer.

4. The process for forming images according to claim 1, wherein said calendering is carried out under conditions of a heating temperature within a range of from 20 to 100° C. and a linear load within a range of from 50 to 1,200 N/cm.

5. The process for forming images according to claim 1, wherein said ink-receiving layer comprises a binder.

6. A process for improving optical density of images formed on a recording medium having an ink-receiving layer that includes inorganic particles comprising the steps of:

calendering said ink-receiving layer with images formed thereon; and laminating a coat layer onto said ink-receiving layer with images formed thereon after the calendering;

wherein said calendering step reduces unevenness at the surface of the ink-receiving layer.

* * * * *